US006173461B1

(12) United States Patent
Alexander

(10) Patent No.: US 6,173,461 B1
(45) Date of Patent: Jan. 16, 2001

(54) SUPPORT UNIT

(76) Inventor: Michael Alexander, The White House, Long Lane near Hermitage, Newbury, Berks RG16 9LY (GB)

( * ) Notice: Under 35 U.S.C. 154(b), the term of this patent shall be extended for 0 days.

(21) Appl. No.: 09/068,252

(22) Filed: May 12, 1998

(30) Foreign Application Priority Data

Sep. 12, 1996 (GB) ..... 9619050

(51) Int. Cl.[7] ..... A47B 7/02
(52) U.S. Cl. ..... 5/618; 5/613; 5/616
(58) Field of Search ..... 5/610, 613, 616, 5/617, 618

(56) References Cited

U.S. PATENT DOCUMENTS 3,041,122 * 6/1962 Weickgenannt et al. ..... 5/618 X
4,629,242 * 12/1986 Schrager ..... 5/86.1
5,072,463 * 12/1991 Willis ..... 5/618
5,083,625 * 1/1992 Bleicher ..... 5/618 X

FOREIGN PATENT DOCUMENTS

0178951 * 10/1985 (EP) .
0558858 * 3/1992 (EP) .
2635681 * 8/1988 (FR) .
91/07157 * 5/1991 (WO) .

* cited by examiner

*Primary Examiner*—Lynne H. Browne
*Assistant Examiner*—James Hewitt

(74) *Attorney, Agent, or Firm*—Davis and Bujold

(57) ABSTRACT

A support unit, for locating a body at different positions relative to another part of the body, comprising a chassis and a working carrier comprising a first section for the trunk, a second section for the thighs, and a third section for the legs. A waist coupling is located between the first section and the second section enabling the first section and second section to rotate relative to one another about a waist axis. A knee coupling is located between the second section and the third section enabling the second section to rotate relative to one another about the knee axis. The waist axis is parallel to the knee axis and separated substantially by the length of the second section. The working carrier at least with the first, second and third sections lie in a substantially common horizontal plane, having in plan overall dimensions substantially greater than the overall dimensions in plan of the chassis. A frame member slidably retaining the first section to support the working carrier at least when the working carrier is substantially horizontal. A variable length column extends between the chassis and the frame member to support the frame member and provide height adjustment. A link serves to limit rotation of the second section towards the first section, at least when the first section is tilted from horizontal. A first variable length longitudinal actuator for enabling the frame member and the working carrier to be rotated relative to the chassis about a horizontal main axis, and a second variable length longitudinal actuator for enabling the first section to be displaced linearly relative to the working carrier. A control mechanism controls operation of the support unit.

10 Claims, 4 Drawing Sheets

SUPPORT UNIT

TECHNICAL FIELD

This invention relates to a support unit. It is in particular concerned with a support unit for an individual suffering from spinal or other incapacitating injuries to enable them to be supported in various attitudes. For such a person there frequently arises a need to provide for parts of the body to be capable of relative changes in position and for changes to occur at frequent intervals. Thus for comfort and for physiotherapeutic benefits there can be advantages in providing for relative difference in alignment between the three main body sections: the head and trunk, the thighs and the legs. In addition alignment changes of the head relative to the trunk and of the feet relative to the legs provide advantages. In a completely reclined posture it is necessary to maintain the three main body sections in line on what amounts to a flat surface (though this need not necessarily be horizontal). As recovery occurs or for nursing requirements there can arise a need to raise, while maintaining full support for, the trunk so as to align it at an angle relative to the thighs and legs. A further need can arise for a patient to sit up so that the trunk and legs are near vertical and the thighs near horizontal. Finally there are benefits to be had from supporting the patient in a vertical or near vertical position.

BACKGROUND ART

European Patent Publication 0 178 951 (Grantham) shows a convertible hospital bed in which an upper bed frame, bearing a mattress, which is movable over a lower bed frame towards the foot of the bed while elevating the trunk of the occupant. In this way the occupant arrives at the foot of the bed in an upright seated position. In this case the bed serves as a stable framework on which the occupant can readily be moved. Grantham acknowledges that the invention is for beds of the 'hospital' type 'being particularly designed for use in hospitals and nursing homes or for residential use with patients who are possibly ambulatory but too weak or incapacitated to get into and out of bed without assistance'. Grantham does not suggest that the bed can usefully be operated by the occupant.

U.S. Pat. No. 4,613,997 (Langdale) discloses a convalescent bed with a base frame and support frame for a mattress pivotally mounted for movement between horizontal and vertical positions. The support frame provides a support portion for the trunk and legs and a hinged portion for the head. The bed is provided with power mechanism to move the support frame as a unit between horizontal and vertical positions. No seating position is provided. As in EPO 0178951 Langdale relies on the structural support provided by a full size bed frame during movement of the support frame. The bed disclosed by Langdale also requires operation by skilled staff.

DISCLOSURE OF INVENTION

According to the present invention there is provided a support unit comprising:

(1) a chassis, (2) a working carrier for a human body comprising a first section for the trunk, a second section for the thighs, and a third section for the legs;

a waist coupling between the first section and the second section enabling the first and second section to rotate relative to one another about a waist axis;

a knee coupling between the second section and the third section enabling the second section and third section to rotate relative to one another about a knee axis;

the waist axis being parallel to the knee axis and separated substantially by the length of the second section;

the working carrier, at least with the first, second and third sections lying in a substantially common horizontal plane, having overall dimensions substantially greater than the overall dimensions of the chassis;

(3) a frame member slidably retaining the first section and to support the working carrier at least when the working carrier is at or near the horizontal;

(4) a column of variable length extending between the chassis and the frame member to support the frame member and to provide for height adjustment of the frame member;

(5) a link having a first end pivotably attached to the frame member and the other end to the first end pivotably attached to the second section or an extension thereof in the region of the knee axis; the link serving to limit rotation of the second section towards the first at least when the first section is tilted from the horizontal;

(6) a first longitudinal actuator having a first end pivotably attached to the column or an extension thereof and the other end to the first end pivotably attached to the frame member; the first actuator being of variable length between the first end and the other end to the first end to enable the frame member, and so the working carrier, to be rotated relative to the chassis about a horizontal main axis;

(7) a second longitudinal actuator having a first end pivotably attached to the frame member or an extension thereof and the other end to the first end pivotably attached to the first section; the second actuator being of variable length between its first end and its other end to the first to enable the first section to be displaced linearly relative to the working carrier;

(8) control means regulating operation of the column and the alignment means; and (9) means for energising the column and alignment means.

According to a first preferred version of the present invention the third section is provided with a foot rest.

According to a second preferred version of the present invention or the first preferred version thereof there are provided arm or shoulder supports or rests mounted on the first section.

According to a third preferred version of the present invention or any preceding preferred version thereof including retaining means such as a belt for retaining an occupant relative to the working carrier.

According to a fourth preferred version of the present invention or any preceding preferred version thereof the means for energising is a mains electrical supply, storage battery or a source of compressed fluid.

According to a fifth preferred version of the present invention or any preceding preferred version thereof the chassis is provided with ground engaging means such as wheels or tracks providing for mobility of the unit.

According to a sixth preferred version of the present invention or any preceding preferred version thereof there is provided a stabilising member which can be extended from the chassis or an extension thereof into ground engagement to increase stability of the unit; the stabilising member being retractable into the chassis or the extension thereof to enable the chassis alone to support the remainder of the unit, typically the chassis is provided wherein the stabilising member comprises a longitudinally extendible beam and an associated ground engaging means such as a wheel so that, at least with the three sections substantially horizontally, the extendible beam is automatically or otherwise deployed so that the associated ground engaging means contacts the ground at some distance from the remainder of the chassis to increase stability of the unit.

According to a seventh preferred version of the present invention a support unit according to the fifth preferred version includes at leats one motor adapted for powering by the means for energising some or all of the ground engaging means to provide for propulsion of the support unit.

According to an eighth preferred version of the present invention or any preceding preferred version thereof there is provided an anchoring means, such as a jack, which is automatically or otherwise deployed with the unit in a given configuration to resist displacement of the unit relative to the ground.

According to a ninth preferred version of the present invention or any preceding preferred version thereof the control means includes a control unit providing for the input of signals for controlled operation of the unit whether by manual manipulation, breath control, muscle or nerve sensing or in some other way compatible with the ability of an occupant of the support unit.

According to a tenth preferred version of the present invention a support unit according to the ninth preferred versions includes a further control unit providing for the input of signals for controlled operation of the unit which signals are adapted to override or otherwise suppress those of the control unit.

According to an eleventh preferred version of the present invention a support unit according to the ninth or tenth preferred versions has a control means including programmed information governing the type of operation (or the rate, or a function thereof, at which it can occur) that can be undertaken on the input of signals by way of the control unit and/or the further control unit.

The support unit of the present invention by facilitating movement of a patient will benefit carers and nurses who with currently available methods of patient handling, especially lifting, suffer back and muscular problems lead to an inability to undertake lifting if not absence from work for an extended period.

Mobile version of the present invention provides for stable and ready movement of the unit with an occupant. Such a version can include one or more motor driven wheels or tracks which can be used to propel the unit with its occupant when an occupant can safely do so the control system can be operated by the occupant. The ability provided by the unit to enable an occupant to regulate his immediate physical support and experience a degree of mobility can provide a major psychological benefit. This can be especially significant when the incapacity of the occupant has arisen suddenly following a major accident prior to which the occupant was physically extremely active.

BRIEF DESCRIPTION OF DRAWINGS

An exemplary embodiment of the invention will now be described with reference to the accompanying drawings of a spinal support unit of which.

MODE FOR CARRYING OUT THE INVENTION

Figure 1:
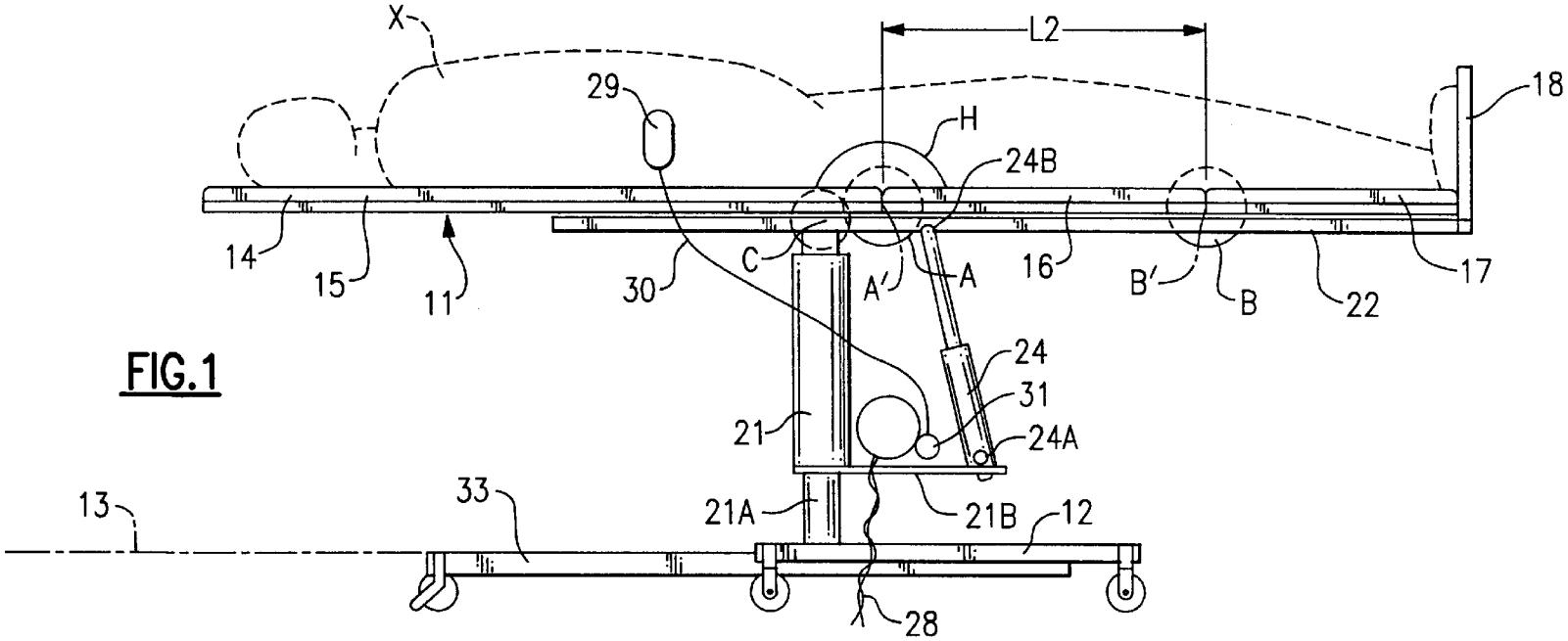
FIG. 1 is a side view of the unit with the component parts in a first relative position with a user lying horizontally.

The drawings variously show a spinal support unit 11 with a chassis 12 with wheels R. The chassis 12 has a longitudinal axis 13 and has mounted on it a working carrier 14. The working carrier 14 serves to support an occupant X shown in broken outline. The carrier 14 is in three distinct sections 15, 16, 17 capable of relative rotational movement. The first section 15 serves to support the trunk of the occupant X; the second section 16 to support the thighs; and the third section 17 the legs (and is in addition equipped with a foot rest 18 to prevent longitudinal movement of occupant X relative to the carrier 14).

The first section 15 of support is pivotably attached by coupling A to the second section 16 to enable the first section 15 to be rotated relative to the second section 16 about waist axis A'.

The second section 16 is pivotably attached by coupling B to the third section 17 to enable the second section 16 to be rotated relative to the third section 17 about knee axis B' which is parallel to waist axis A' and off set from it by an amount corresponding to length L2 of the second section 16.

Figure 4:
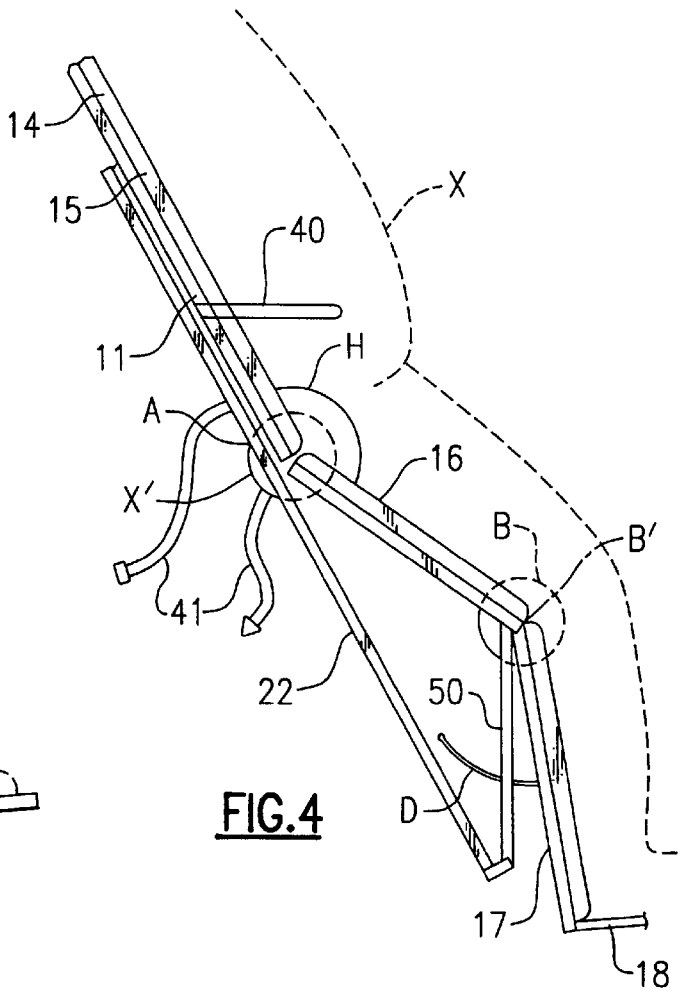
FIG. 4 is a side view of a major part of the unit with the component parts in a fourth relative position with a user in a supported and near standing position.

An electro-mechanical ram 21 with piston 21A serves to support frame 22 which in turn slidably supports first section 15. The ram 21 serves to vertically raise or lower frame 22 and so carrier 14. The ram 21 is coupled by pivot C to the support frame 22 to enable the frame 22 to be pivoted about main axis C' by means of a first actuator 24 which is pivotably attached: at end 24A to extension 21B of the ram 21 and at end 24B to frame 22. By varying the length of the first actuator 24 the support frame 22 can be rotated about main axis C' from the horizontal as shown in FIG. 1 to the near vertical as shown in FIG. 4.

A second actuator 25 (shown only in FIG. 3B) is pivotably attached: at end 25A to cross member 22' and at end 25B to extension E on the underside of first section 15 of the carrier 14. By varying the length of the second actuator the first section 15 can be displaced relative to the carrier frame 22 by means of longitudinal tongues on the sides of section 15 slidably engaging complementary slots in the frame 22.

The remaining second section 16 and third section 17 while not engaging directly with support frame 22 do seat upon the support frame when it is horizontal and they are lying in the same plane as the first section 15. They are constrained in other ways to respond to displacement of first section 15 under linear displacement by second actuator 25 so as to adopt configurations other than the horizontal shown in FIG. 1.

Figure 1A:
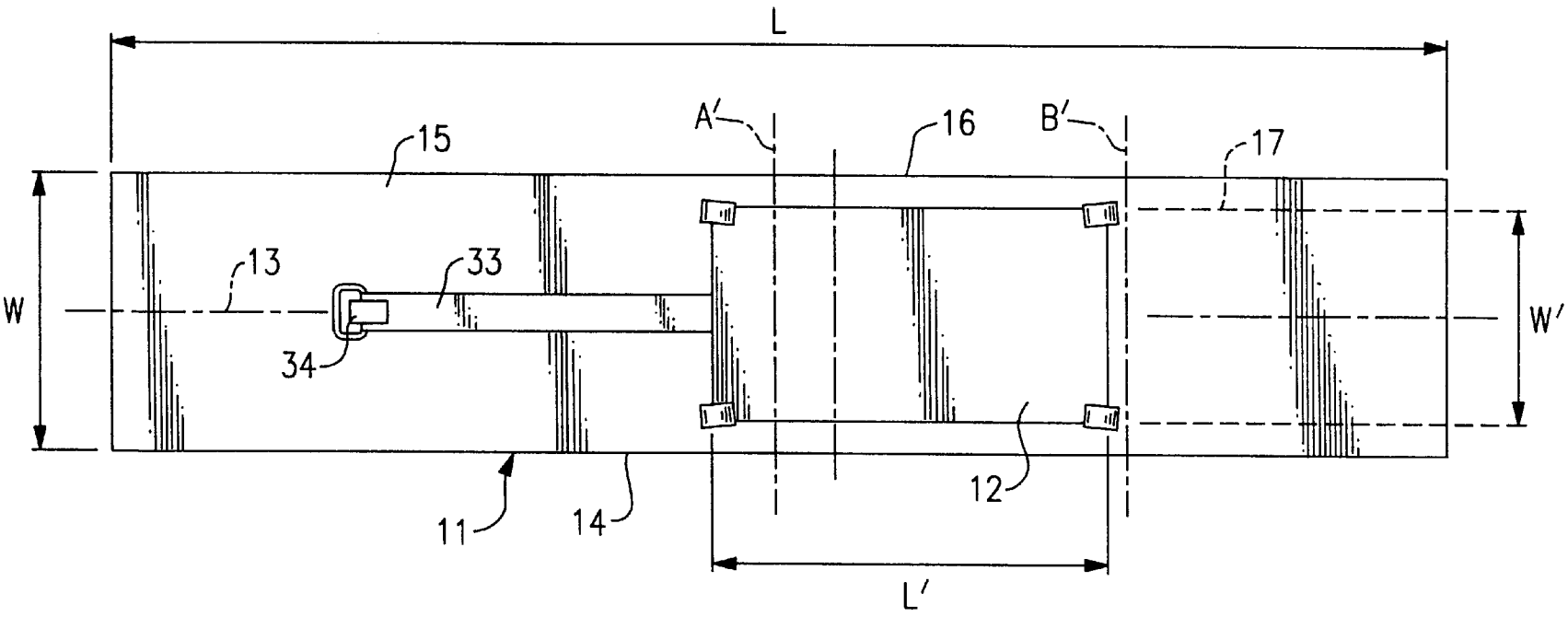
FIG. 1A is a plan view from underneath in direction of arrow 1A shown in FIG. 1.

FIG. 1A shows the unit in the configuration of FIG. 1 seen from underneath working carrier 14 in its fully extended horizontal position with outside dimensions length L and width W. The chassis 12 with outside dimensions length L' and width W' is shown off-set to one side of the main axis C'. It will be seen that the outside dimensions L', W' of the chassis are substantially less than the outside dimensions L, W of the working carrier 14. To provide for enhanced stability for the unit 11 in this configuration an extendible extension leg 33 is provided with a ground engaging wheel brace and wheel arrangement 34 mounted for rearward extension from the chassis 12 to the position shown. When the working carrier 14 is realigned to take up the configuration shown in FIGS. 3 and 4 the extension leg 33 is retracted so that the unit 11 is carried on the chassis 12 alone.

The unit 11 is powered in this case by way of a main supply cable 28. For a fully mobile arrangement one or more batteries can located well down on the chassis 12 so providing for enhanced stability for the unit as a whole by lowering the center of gravity of the unit 11 from that arising when no batteries are used.

Operation of the ram 21, first actuator 24 and second actuator 25 is regulated by way of a hand control 29 coupled by cable 30 to processor 31 which incorporates a programmed memory incorporating safety factors which ensure that the user cannot cause, whether inadvertently or not, a dangerous or inconvenient sequence of events to occur. The hand control 29 can be operated by an occupant of the bed or by a carer for the occupant. If necessary if the hand control 29 is to be operated by the user means can be provided limiting what can be achieved by way of the hand control. An override control is fitted for the purpose of safety for manual use by the carer.

Figure 2:
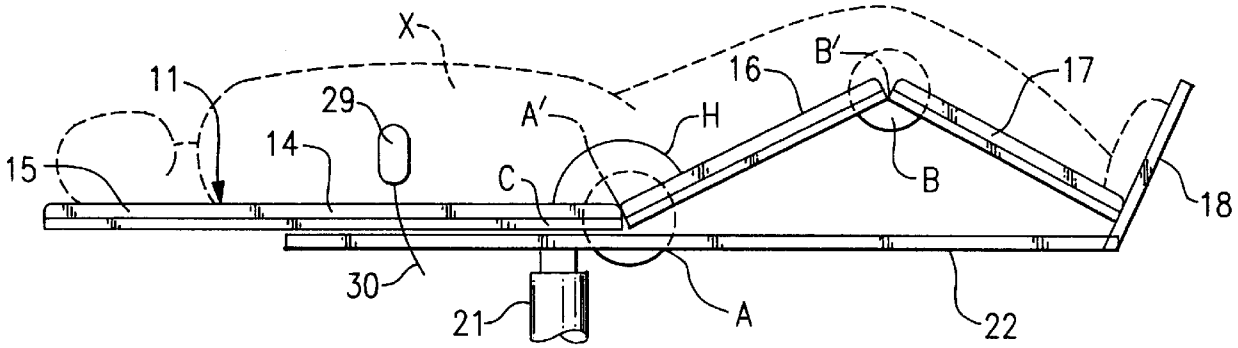
FIG. 2 is a side view of the unit with the component parts in a second relative position with a user lying in a knees raised position.

FIG. 2 shows the unit 11 with the second section 16 and third section 17 raised to provide an angled leg position for the occupant whose trunk remain substantially level on section 15.

The transition from the configuration shown in FIG. 1 to that in FIG. 2 is achieved by operating the second actuator 25 to cause the first section 15 to be drawn to the right from the extended position shown in FIG. 1 where sections 16, 17 rest on the working carrier 14. By displacing first section 15 to the right second section 16 is caused to pivot in an anti-clockwise direction about axis A' and third section 17 is caused to pivot in a clockwise direction about axis B'. The speed of this transition is governed to ensure that the occupant X is not subject to any significant strains and ensures that the underside of virtually all parts of the body are supported.

FIGS. 1 to 2 show relative locations in which the working carrier 14 is maintained horizontal relative to main axis C by way of first actuator 24.

Figure 3A:
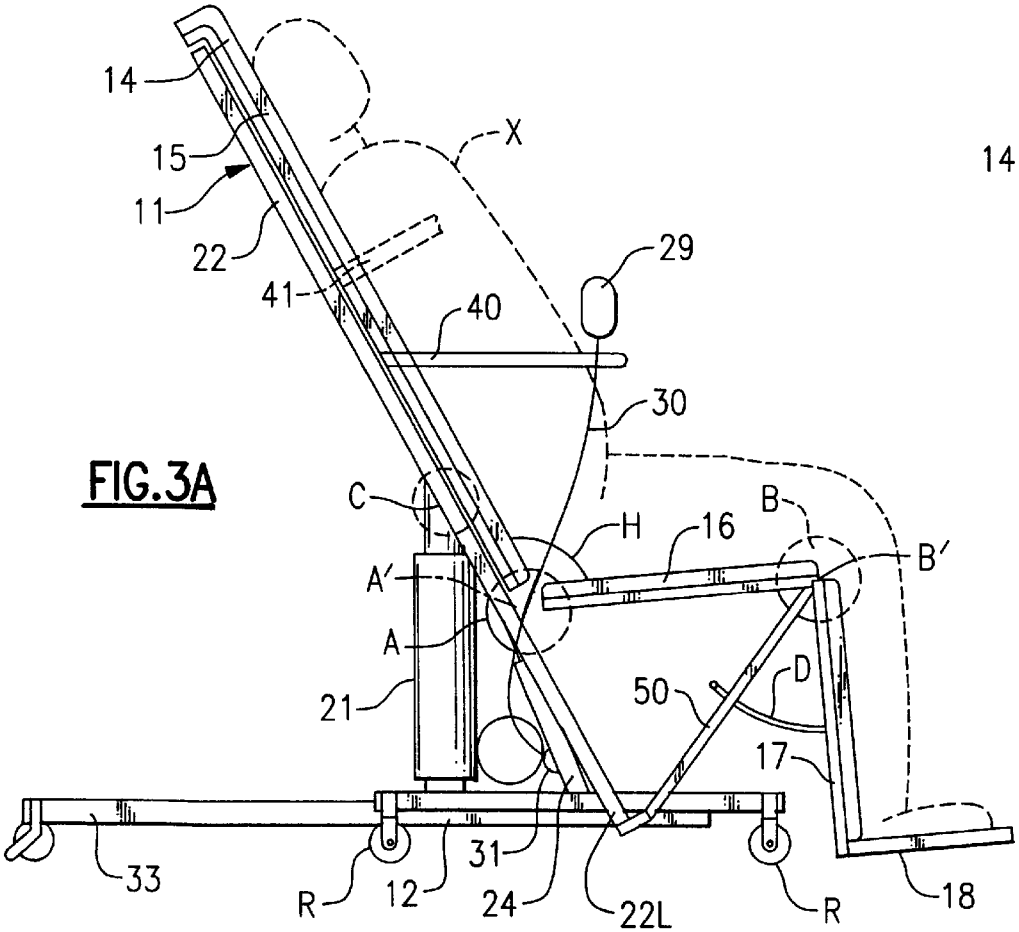
FIG. 3A is a side view of the unit with the component parts in a third relative position with a seated user.
Figure 3B:
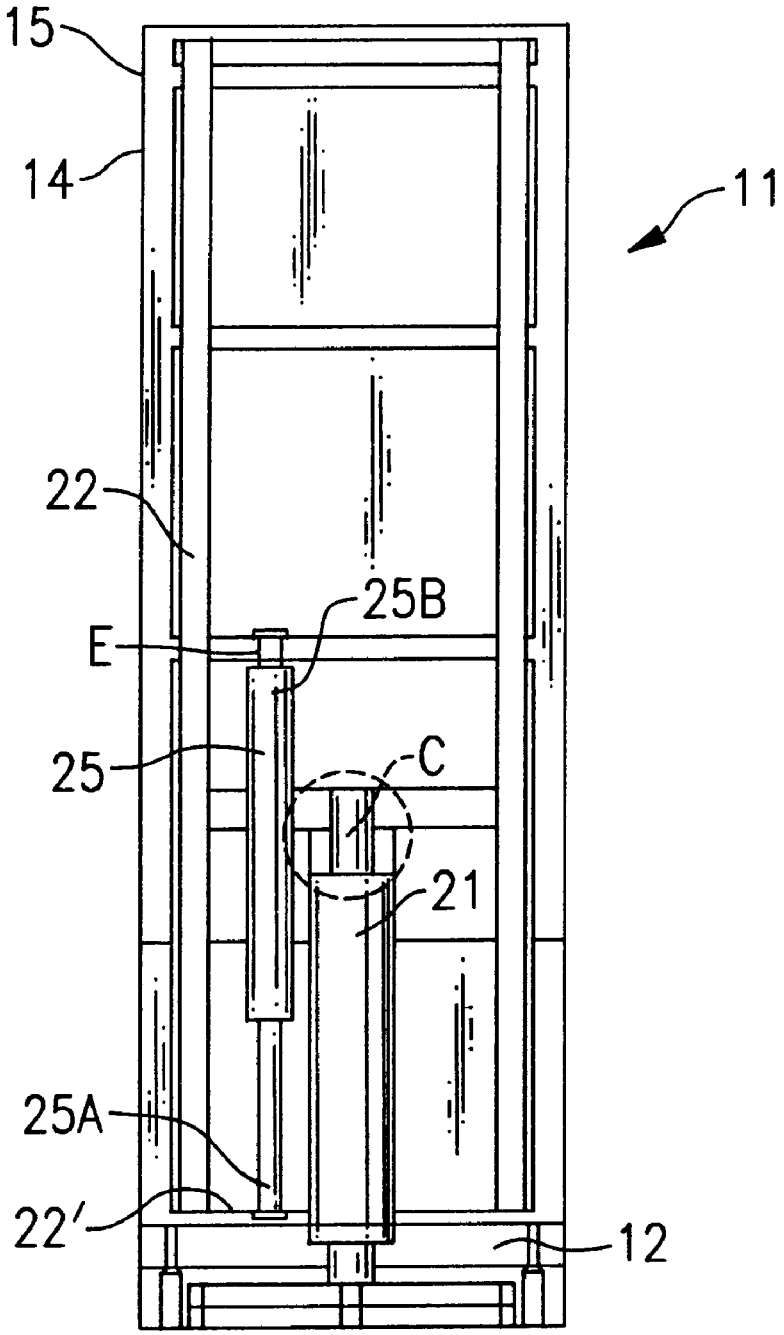
FIG. 3B is a rear end view of the unit in the direction of arrow 3B shown in FIG. 3A.

FIGS. 3A and 3B variously show the unit 11 configured as a seat where the first section 15 and the third section 17 is positioned at a position approaching the vertical as is convenient. To support the occupant X when the working carrier is moved from the horizontal arm rests 40 are pivoted to project upwardly from the first section 15 to which they are pivotably attached.

Progression to the sitting and thereafter standing configuration from that shown in FIG. 2 is achieved from the configuration of FIG. 2 by:

operating first actuator 24 to tilt the carrier frame 22 about main axis C in a clockwise direction; and operating the second actuator 25 to draw the first section 15 further to the right so causing the second section 16 to pivot in an anticlockwise direction so reducing the angle H between the first and second sections in FIG. 2 to the angle S in FIG. 3.

A link 50 (FIG. 3A) is provided pivotably linking lower end 22L of frame 22 and forward end of second section 16 in the vicinity of axis B'. Link 50 serves to constrain movement of the second section 16 and third section 17 when the carrier frame 22 tilts towards the vertical. Motion of the third section 17 is further constrained by a curved restraint D so that the third section 17 cannot pivot further in a anti-clockwise direction relative to the second section 16 as the first section rises towards the vertical. This serves to prevent any undue strain being placed on the knees and legs of the occupant X.

FIG. 4 shows the upper parts of the unit 11 where the occupant X has been raised to a near standing position while provided with support by way of arm rests 40. If necessary the effect of the arm rests 40 can be in addition to a retaining strap 41 across the chest of the occupant X.

The transitions between the various configurations shown in the figures are programmed to occur at a reasonable rate and without the relative positions of the sections ever ceasing to provide a degree of support or at least of alignment for all parts of the body of the occupant. The control unit 31 is programmed to ensure that the rates and rates of change of relative movement between the various sections of the support do not adversely affect the occupant.

The ram 21 provides for the vertical height of the sections when bearing the occupant to be readily controlled. This is particularly beneficial for transferring the occupant between the unit 11 and, say, a bed. The sections 15–17 of the unit are readily raised or lowered relative to the horizontal to lie in common plane with the bed top so enabling a carer to move the occupant from one to the other.

INDUSTRIAL APPLICABILITY

A major benefit of the unit according to the present invention is the ability it provides for an occupant of the unit in their own time and without the need for a carer to be present to adjust the set up of the unit so that configuration of the body of the occupant is in an appropriate configuration. For the permanently disabled this can serve to generate a degree of independence having psychological and other advantages. In the event the occupant has not got, or cannot make use, of a hand then the hand control 29 can be replaced by a control which is located for ready operation so that whatever action can be provided by the occupant (such as finger movement, blowing or sensing means able to detect two levels of state of muscle, nerve or other function which levels can be decoded or otherwise detected) and used to govern unit functions.

In an alternative embodiment a unit corresponding in other respects to unit 11 can be provided with propulsion means to enable the combination of occupant and unit to drive or be driven. Again the control unit can be used to provide interlocks or other regulation so that the unit can only be moved when the sections supporting the occupant are in a suitable configuration.

It will be apparent that the invention provides a compact means for providing safe overall support to an occupant while providing for controlled movement of parts of the occupants body between various configurations. The unit of the present invention is relatively compact and readily moved around in limited space such as can arise in a domestic or residential environment.

The unit provides support over a range from fully extended occupant lying flat to a raised knee position with thigh and legs at an angle to each other and to the body to a seated position to a fully upright or near upright stance. All movement are governed by actuators and a ram whose operation is readily controlled by a micro-processor.

Brakes, jacks or wheel lifts can be provided to ensure that, for example, when the unit is aligned with, say, a bed to ensure that there will be no movement of the unit relative to the bed while transfer of an occupant is made from the unit to the bed or vice versa. Means can also be provided to ensure that the footplate 18 can be anchored to the floor when the sections approach the upright position shown in FIG. 4. In passing from the configuration shown in FIGS. 1 or 2 to the seated position shown in FIG. 3 and on to the near standing one in FIG. 4 the micro processor provides for the extension leg 33 to retract into the chassis 12 so causing less obstruction at the rear of the unit.

The arm supports 40 can likewise be extended or retracted automatically as the unit moves towards or away from the vertical as shown in FIG. 4 to ensure that the upper part of the body of an occupant is supported.

A unit based on the present invention is capable of being equipped with items from a wide range of adjuncts and accessories depending on the particular applications required. A unit according to the present invention can be equipped with equipment such as a wireless whereby an occupant can readily signal for assistance in the event a problem arises.

What is claimed is:

1. A mobile support unit for a human occupant comprising:

a wheeled chassis (12) for providing mobility of the support unit along a supporting surface;

a segmented support carrier (14) for the occupant comprising a first section (15) for a trunk of the occupant, a second section (16) for thighs of the occupant, and a third section (17) for legs of the occupant; a waist coupling (A) located between the first section (15) and the second section (16) for enabling the first section (15) and the second section (16) to rotate relative to one another about a waist axis (A'); a knee coupling (B) located between the second section (16) and the third section (17) for enabling the second section (16) and the third section (17) to rotate relative to one another about a knee axis (B'); the waist axis (A') extending parallel to the knees axis (B') and being separated from one another by the second section (16); the segmented support carrier (14), when the first (15), the second (16) and the third sections (17) are in an extended position, lying in a common substantially horizontal plane and having in an overall length and width dimension (L, W) which is substantially greater than an overall length and width dimension (L', W") of the wheeled chassis (12);

a frame member (22) slidably retaining the first section (15) and supporting the segmented support carrier (14) when the segmented support carrier (14) is in the horizontal plane;

an adjustable column (21, 21A) extending between the chassis (12) and the frame member (22) to support the frame member (22) and to provide for height adjustment of the frame member (22);

a link (50) having a first end (22L) pivotably attached to the frame member (22) and a second end pivotally attached to the second section (16) adjacent the knee axis (B'); the link (50) facilitating limited rotation of the second section (16) towards the first section (15) at least when the first section (15) is tilted from the horizontal plane;

a first longitudinal actuator (24) having a first end (24A) pivotally attached to the column (21, 21A) and a second end (24B) pivotally attached to the frame member (22); a length of the first actuator (24) being adjustable to enable the frame member (22) and the segmented support carrier (14) to be rotated relative to the chassis (12) about a horizontal main axis (C');

a second longitudinal actuator (25) having a first end (25A) pivotally attached to the frame member (22) and a second end (E) pivotally attached to the first section (15); the second actuator (25) being adjustable to enable the first section (15) to be displaced linearly relative to the segmented support carrier (14);

control means (29, 30, 31) for controlling operation of the column (21) and the first and second actuators via an energizing source (28) which activates the column and first and second actuators; and the frame member (22) and segmented support carrier (14) for ensuring that a center of gravity of the occupant, supported by the support unit, lies within a support perimeter defined by the wheeled chassis.

2. The support unit as claimed in claim 1, wherein supports (40) are provided for the arms and the shoulders of the occupant, and the supports are attached to the first section (15).

3. The support unit as claimed in claim 1, wherein the energizing source comprises one of an electrical connection to a remote electric power supply (28), an electrical battery and a source of compressed fluid.

4. The support unit as claimed in claim 1, wherein a motor powered by the energizing source is coupled to at least one wheel (R) of the chassis to provide propulsion of the support unit (11).

5. The support unit as claimed in claim 1, wherein the support unit includes a jack which when deployed resists displacement of the unit (11) relative to the supporting surface.

6. The support unit as claimed in claim 1, wherein said control means includes a personal control unit for for controlled operation of the support unit via at least one of manual manipulation, breath control and muscle and nerve sensing.

7. The support unit as claimed in claim 6, wherein a further safety control unit also provides for input of safety signals for controlled operation of the support unit, the safety signals being adapted to override those of the personal control unit.

8. The support unit as claimed in claim 7, wherein the control means includes programmed information governing the type of operation that can be undertaken based upon the input of signals from one of the control unit and the safety control unit.

9. A mobile support unit for a human occupant comprising:

a wheeled chassis (12) for providing mobility of the support unit along a supporting surface;

a segmented support carrier (14) for the occupant comprising a first section (15) for a trunk of the occupant, a second section (16) for thighs of the occupant, and a third section (17) for legs of the occupant; a waist coupling (A) located between the first section (15) and the second section (16) for enabling the first section (15) and the second section (16) to rotate relative to one another about a waist axis (A'); a knee coupling (B) located between the second section (16) and the third section (17) for enabling the second section (16) and the third section (17) to rotate relative to one another about a knee axis (B'); the waist axis (A') extending parallel to the knees axis (B') and being separated from one another by the second section (16); the segmented support carrier (14), when the first (15), the second (16) and the third sections (17) are in an extended position, lying in a common substantially horizontal plane and having in an overall length and width dimension (L, W) which is substantially greater than an overall length and width dimension (L', W") of the wheeled chassis (12);

a frame member (22) slidably retaining the first section (15) and supporting the segmented support carrier (14) when the segmented support carrier (14) is in the horizontal plane;

an adjustable column (21, 21A) extending between the chassis (12) and the frame member (22) to support the frame member (22) and to provide for height adjustment of the frame member (22);

a link (50) having a first end (22L) pivotally attached to the frame member (22) and a second end pivotally attached to the second section (16) adjacent the knee axis (B'); the link (50) facilitating limited rotation of the second section (16) towards the first section (15) at least when the first section (15) is tilted from the horizontal plane;

a first longitudinal actuator (24) having a first end (24A) pivotally attached to the column (21, 21A) and a second end (24B) pivotally attached to the frame member (22); a length of the first actuator (24) being adjustable to enable the frame member (22) and the segmented support carrier (14) to be rotated relative to the chassis (12) about a horizontal main axis (C');

a second longitudinal actuator (25) having a first end (25A) pivotally attached to the frame member (22) and a second end (E) pivotally attached to the first section (15); the second actuator (25) being adjustable to enable the first section (15) to be displaced linearly relative to the segmented support carrier (14);

control means (29, 30, 31) for controlling operation of the column (21) and the first and second actuators via an energizing source (28) which activates the column and first and second actuators; and the frame member (22) and segmented support carrier (14) for ensuring that a center of gravity of the occupant, supported by the support unit, lies within a support perimeter defined by the wheeled chassis; and a retractable stabilizing member (33, 34) extending from the chassis (12) into engagement with the supporting surface to increase stability of the support unit (11); the stabilizing member (33, 34) is retractable into the chassis (12) to enable the chassis (12) alone to support a remainder of the support unit (11); and the stabilizing member serves to increase the support perimeter for the support unit (11).

10. The support unit as claimed in claim 9, wherein the stabilizing member (33, 34) comprises a longitudinally extendible beam (33) which has an associated surface engaging support (34) so that when the first second and third sections (15, 16, 17) are moved to a substantially horizontal position, the extendible beam (33) is deployed so that the associated surface engaging support (34) contacts the supporting surface to increase the support perimeter defined by engagement of the wheeled chassis with the supporting surface.

* * * * *